US005406679A

United States Patent [19]

Leifeld et al.

[11] Patent Number: 5,406,679

[45] Date of Patent: Apr. 18, 1995

[54] WEB GUIDING AND SUPPORTING DEVICE AT THE OUTLET OF A CARDING MACHINE

[75] Inventors: Ferdinand Leifeld, Kempen; Wilfried Weber, Mönchengladbach, both of Germany

[73] Assignee: Trützschler GmbH & Co. KG, Mönchengladbach, Germany

[21] Appl. No.: 160,907

[22] Filed: Dec. 3, 1993

[30] Foreign Application Priority Data

Dec. 4, 1992 [DE] Germany ..... 42 40 820.2
Oct. 18, 1993 [DE] Germany ..... 43 35 444.0

[51] Int. Cl.[6] ..... D01G 15/46
[52] U.S. Cl. ..... 19/106 R; 19/150
[58] Field of Search ..... 19/106 R, 150, 151, 19/288, 291

[56] References Cited

U.S. PATENT DOCUMENTS

| | | | |
|---|---|---|---|
| 2,206,232 | 7/1940 | Martin | 19/288 |
| 3,020,600 | 2/1962 | West | 19/288 X |
| 3,448,571 | 4/1969 | Tsuzuki | 19/288 X |
| 4,213,553 | 7/1980 | Leifeld | 19/288 X |
| 4,272,866 | 6/1981 | Vollrath | 19/150 |
| 4,364,152 | 12/1982 | Rauschen et al. | 19/106 R X |
| 4,630,336 | 12/1986 | Schopwinkel et al. | 19/288 |
| 4,763,387 | 8/1988 | Bothner | 19/288 |
| 4,884,320 | 12/1989 | Gasser et al. | 19/106 R |
| 5,018,246 | 5/1991 | Leifeld | 19/150 |

FOREIGN PATENT DOCUMENTS

| | | | |
|---|---|---|---|
| 0370232 | 5/1990 | European Pat. Off. . | |
| 1685578 | 1/1974 | Germany . | |
| 2836979 | 3/1980 | Germany . | |
| 3722771 | 2/1989 | Germany . | |
| 3802279 | 8/1989 | Germany . | |
| 0531578 | 1/1973 | Switzerland | 19/150 |
| 216511 | 8/1924 | United Kingdom . | |
| 550908 | 1/1943 | United Kingdom . | |
| 669948 | 4/1952 | United Kingdom . | |
| 928397 | 6/1963 | United Kingdom . | |
| 1211020 | 11/1970 | United Kingdom . | |
| 1223487 | 2/1971 | United Kingdom . | |
| 2178074 | 2/1987 | United Kingdom . | |

*Primary Examiner*—Clifford D. Crowder
*Assistant Examiner*—Ismael Izaguirre
*Attorney, Agent, or Firm*—Spencer, Frank & Schneider

[57] ABSTRACT

A carding machine includes a web delivering mechanism formed of a pair of cooperating rolls, for discharging a fiber web; and a web guiding element positioned immediately downstream of the roll pair as viewed in the direction of web advance. The web guiding element has an inner surface oriented towards the roll pair and is arranged transversely to the plane of the web for guiding and gathering the web. The web guiding element further has a web passage aperture through which the gathered web passes and leaves the web guiding element. A guiding body is positioned between the roll pair and the web guiding element in a zone of the aperture. The guiding body includes a supporting surface for supporting the gathered web prior to the passage thereof through the aperture.

39 Claims, 10 Drawing Sheets

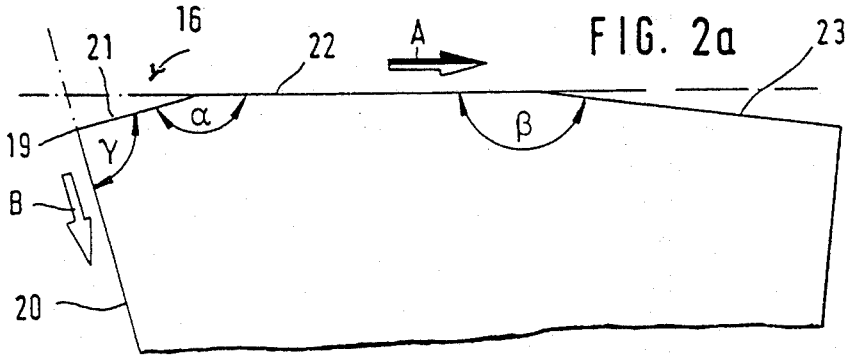
FIG. 2a
FIG. 3
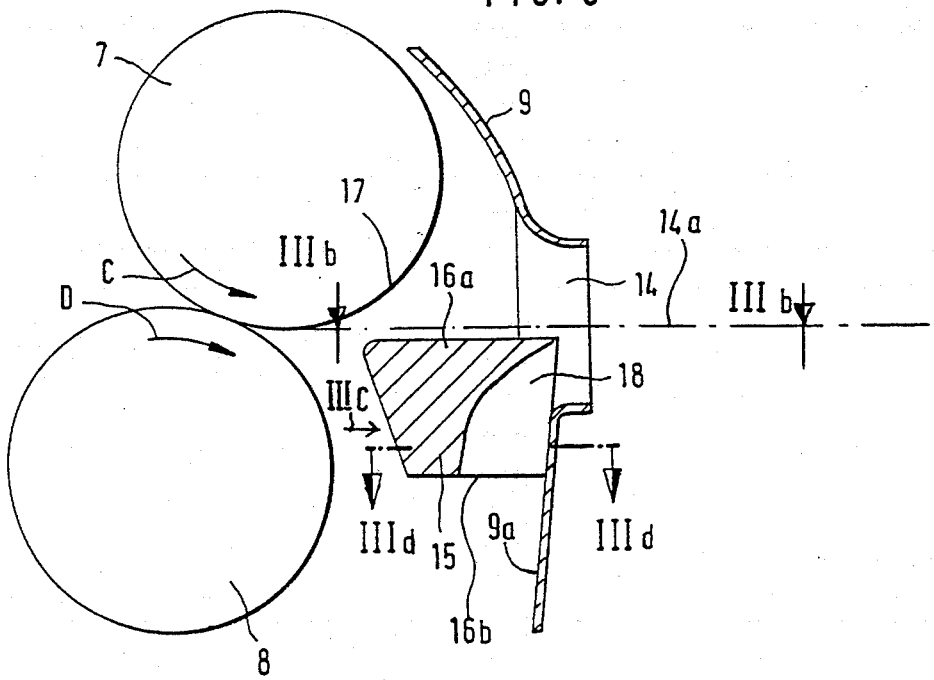

WEB GUIDING AND SUPPORTING DEVICE AT THE OUTLET OF A CARDING MACHINE

CROSS REFERENCE TO RELATED APPLICATION

This application claims the priority of German Application No. P 42 40 820.2 filed Dec. 4, 1992 and German Application No. P 43 35 444.0 filed Oct. 18, 1993, which are incorporated herein by reference.

BACKGROUND OF THE INVENTION

The invention relates to a carding machine, and is more particularly directed to a device for taking off and gathering a fiber web discharged by a fiber web delivering mechanism forming part of the carding machine. The device includes a web guiding element which is arranged immediately downstream of the web delivering mechanism formed of a pair of cooperating rolls. The guide element has a fixed guiding surface which traverses the plane of the running fiber web and which is provided with an aperture for the passage of the gathered web. The upper longitudinal edge of the aperture immediately adjoins the upper roll of the web delivering mechanism, while the lower longitudinal edge of the aperture is situated at a distance from the lower roll so that the web guiding element is downwardly open.

In a known device of the above-outlined type the lower longitudinal edge of the web guiding element is arranged along its entire width at a distance from the lower roll of the web delivering mechanism so that the web guiding element is in its entirety open in the downward direction. In such a device the gathered fiber web passes through the aperture in the web guiding element immediately into the trumpet and leaves the same as a sliver. Upon increasing the output velocity of the carding machine, that is, upon an increase of the fiber web velocity, for example, to 300 m/min or more, the air stream flowing backwards from the trumpet has a disturbing effect. Also, the fiber web, immediately in front of the trumpet occupies a significantly greater space than the compressed sliver emitted by the trumpet. The surrounding air is entrained by the web into the trumpet, and the higher the fiber velocity, the higher the flow rate of air forced into the trumpet. The air which streams rearwardly (that is, against the direction of web advance) from the trumpet, particularly from its narrowest zone, may eventually reach such a high backflow velocity that the incoming fiber web is torn (destroyed) or is zonewise blown back. In case the fiber web is compressed from a large cross-sectional area in the trumpet, then at velocities of above 180 m/min the backflow velocity is excessive. As a result, the fiber web is partially pushed downwardly and is partially torn.

SUMMARY OF THE INVENTION

It is an object of the invention to provide an improved device of the above-outlined type from which the discussed disadvantages are eliminated and which, in particular, ensures a disturbance-free gathering of the fiber web, particularly at high web speeds.

This object and others to become apparent as the specification progresses, are accomplished by the invention, according to which, briefly stated, the carding machine includes a web delivering mechanism formed of a pair of cooperating rolls, for discharging a fiber web; and a web guiding element positioned immediately downstream of the roll pair as viewed in the direction of web advance. The web guiding element has an inner surface oriented towards the roll pair and is arranged transversely to the plane of the web for guiding and gathering the web. The web guiding element further has a web passage aperture through which the gathered web passes and leaves the web guiding element. A guiding body is positioned between the roll pair and the web guiding element in a zone of the aperture. The guiding body includes a supporting surface for supporting the gathered web prior to the passage thereof through the aperture.

The supporting surface of the guiding body backs up the running web from below, particularly at its delicate mid zone. At the same time, the supporting surface of the guiding body guides the fiber web in the direction of the aperture of the web guiding element. By virtue of the fact that the fiber web slides on the supporting surface of the guiding body, particularly over its edge which is oriented towards the roll pair forming the web delivering mechanism, one part of the entrained air is separated early and guided downwardly and thus will not enter the aperture of the web guiding element. A removal of the separated air is effected between the separating edge of the guiding body and the roll pair. The guiding body forms a bridge to partially close, in a downward direction, the zone between the aperture and the roll pair. In this way, small residual web parts which otherwise would be blown backwards, are caught by the upper (supporting) surface of the guiding body and are entrained by the running web towards the aperture. At the same time, trash or other waste which accumulates on the upper surface of the guiding body is entrained by the fiber web whereby a cleaning of the guiding body is effected. The guiding body may be hollow and/or may have a generally rectangular vertical cross section. Its shape may be trapezoidal in which the longest side of the trapezoid is, as viewed in a vertical cross section, a longitudinal side of the supporting surface.

According to a particularly advantageous feature of the invention, the run-on edge of the guiding body is rounded whereby the guiding body has a rounded nose-like portion which ensures a gentle transition of the web onto the body and which also serves for guiding away the air stream.

Expediently, the guiding body is oriented towards the inner surface of the web guiding element and is preferably affixed to the web guiding element.

Advantageously, the guiding body projects into the aperture area of the web guiding element, and the upper supporting surface extends in the direction of the aperture.

Expediently, the run-on edge, that is, the nose-like portion of the guiding body is at a distance from the roll pair of the fiber web delivering mechanism.

Advantageously, the guiding body extends only over the width of the guiding element aperture. Preferably, the width of the guiding body is, as viewed from the top, smaller in the zone of the guiding element aperture than in the zone of the roll pair. In this manner a trapezoid is obtained whose long base lies in the zone of the roll pair.

Expediently, the supporting surface of the guiding body extends at the height level of the guiding element aperture. Advantageously, the guiding body covers at least partially the lower zone of the aperture of the web guiding element.

Preferably, an air outlet opening is provided between the supporting surface of the guiding body and the lower zone of the guiding element aperture. Expediently, an air outlet opening is provided between the supporting surface of the guiding body and the lateral zones of the guiding element aperture. Advantageously, the guiding body has a throughgoing air outlet opening between the supporting surface and the lower surface thereof. Preferably, the supporting surface of the guiding body extends approximately at the height level of the lower end of the guiding element aperture.

Expediently, the guiding body bridges the space between the roll pair (web delivering mechanism) and the guiding element aperture.

According to a particularly advantageous feature of the invention, the supporting surface of guiding body is situated approximately at the height level of the bight of the roll pair. In this manner the fiber web may immediately be supported and guided by the guiding body without a change in the direction of travel. Expediently, in this arrangement the fiber web glides on the supporting surface of the guiding body, and the supporting surface preferably has a low coefficient of friction.

Preferably, an air separating edge is provided on that side of the guiding body which is oriented towards the roll pair. Preferably, an air separating surface is provided on that side of the guiding body which is oriented towards the roll pair. Preferably, the supporting surface and the air separating surface are arranged at an acute angle to one another which is equal to or is smaller than 75° . Preferably, the air separating edge is formed jointly by the end of the supporting surface and the air separating surface. Preferably, the air separating edge is rounded and has a radius of curvature between 0.2 and 4.0 mm. Preferably, at least in one zone the supporting surface is inclined towards the guiding element aperture.

Expediently, the length of the supporting surface is, as measured in the direction of web advance, larger in case shorter fibers are used than in case longer fibers are present.

Preferably, the lateral zones of the supporting surface are rounded. Preferably, the supporting surface has a trough-like shape.

Expediently, the guiding body is a sheet metal member, that is, it is formed of a flat material, such as a deformed sheet member. Preferably, the guiding body has the shape of a hollow frustocone segment, that is, it is funnel shaped, and the large diameter of the funnel has an inclined orientation.

Preferably, the supporting surface has a run-on surface, a carrier surface and an inclined surface. The run-on surface expediently has a width between 0.8 and 2.5 mm; the carrier surface has a width between 8 and 15 mm and the inclined surface has a width between 10 and 30 mm. Preferably, the angle between the run-on surface and the carrier surface is 155° to 170° and the angle between the carrier surface and the inclined surface is 0.5° to 7°. Preferably, the carrier surface extends parallel to the center line between the bight of the roll pair and the guiding element aperture. Expediently, the guiding body has a triangular vertical cross section.

In all the embodiments to be described the web supporting surface of the guiding body extends between the roll pair and the web guiding element to a location (or therebeyond) where the web enters the guiding element aperture.

BRIEF DESCRIPTION OF THE DRAWINGS

FIG. 2*a* is a fragmentary side elevational view of the guiding body shown in FIG. 2.

FIG. 3 is a sectional side elevational view similar to FIG. 2, illustrating another preferred embodiment of the invention.

DESCRIPTION OF THE PREFERRED EMBODIMENTS

Figure 1:
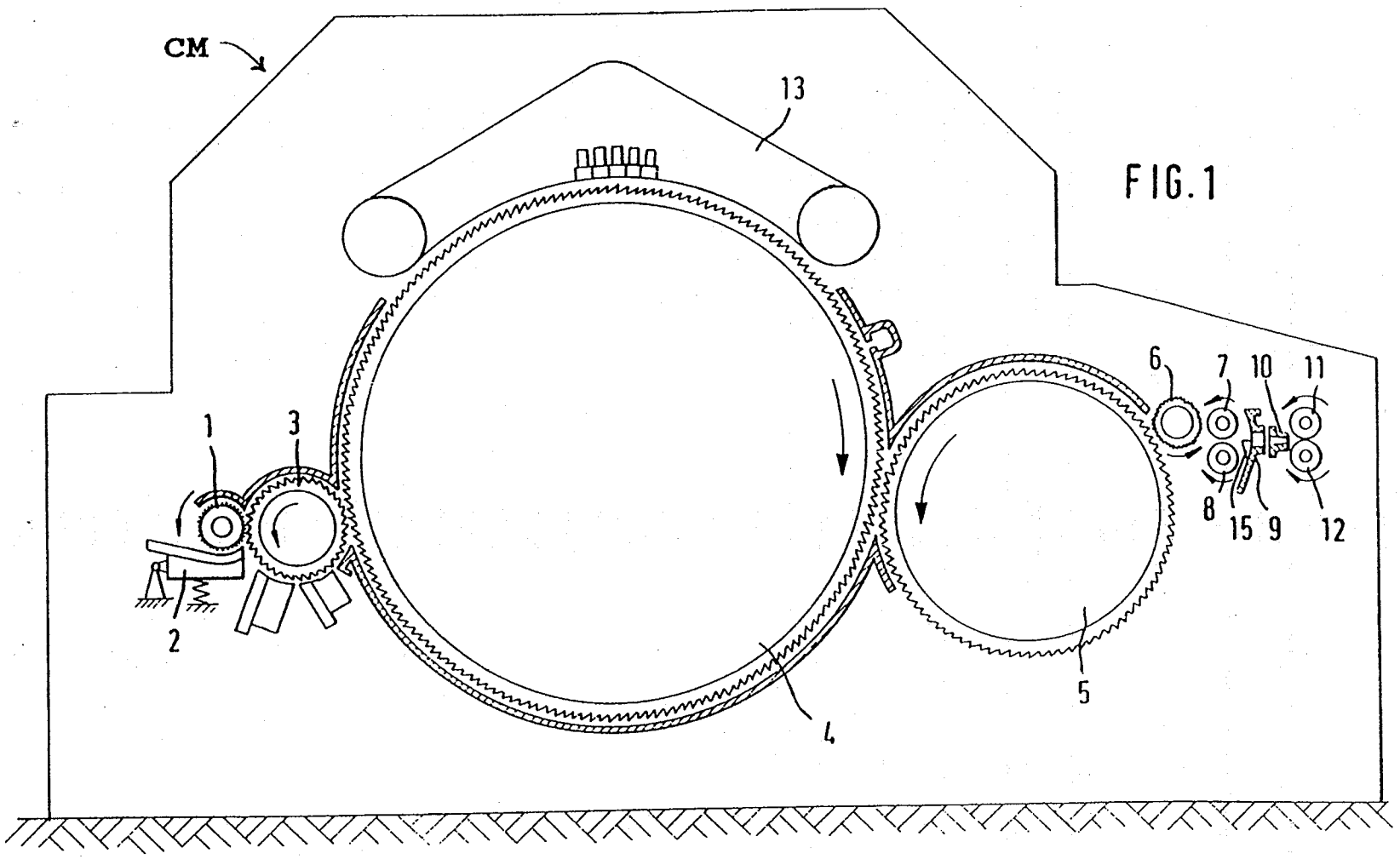
FIG. 1 is a schematic side elevational view of a carding machine incorporating the invention.
Figure 1A:
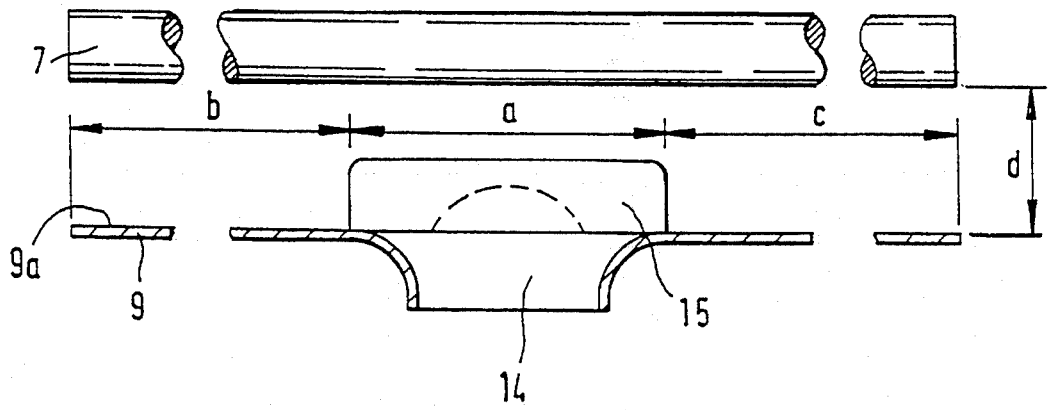
FIG. 1*a* is a sectional top plan view of a web delivering mechanism, a web guiding element and a guiding body according to the invention.

FIG. 1 shows a carding machine CM, for example, an EXACTACARD DK 740 model, manufactured by Trützschler GmbH & Co. KG, Mönchengladbach, Germany. The carding machine CM has a feed roller 1, a feed table 2, a licker-in 3, a main carding cylinder 4, a doffer 5, a stripping roll 6, crushing rolls 7, 8, a web guiding element 9, a trumpet 10, calender rolls 11, 12 as well travelling flats 13. The direction of rotation of the rotary components is indicated in each instance by respective arrows. According to the invention, between the web delivering mechanism formed by the crushing rolls 7, 8 and the web guiding element 9 a guiding body 15 is arranged for supporting the gathered web as it will be described below.

Figure 2:
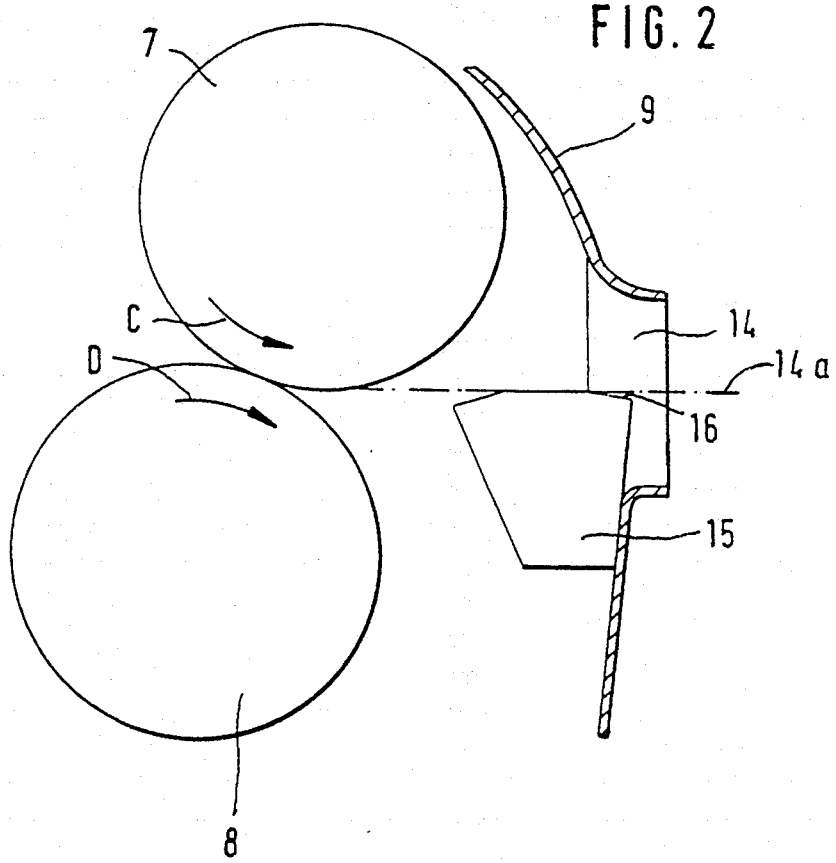
FIG. 2 is a sectional side elevational view of a web delivering mechanism, a web guiding element and a guiding body according to the invention.

FIG. 2 shows that the guiding body 15 has essentially a trapezoidal vertical cross-sectional configuration. The guiding body 15 is mounted on an inner face of the web guiding element 9 and projects from below into the area of a web passage aperture 14, approximately to the center line 14' thereof. The guiding body 15 has a supporting surface 16 which, as shown in FIG. 2*a* is divided into three zones 21, 22 and 23. An air separating edge 19 of the guiding body 15 constitutes a gap boundary between an air separating surface 20 and the surface zone 21 which forms a run-on surface. The inclined run-on surface 21 allows the incoming, non-illustrated fiber web to run on the surface zone 22 which forms a carrier surface, without contacting the air separating edge 19. The web carries with it a minimal air cushion and is, to a certain extent, lubricated thereby as it runs on the carrier surface 22. Thus, the web, as it runs on the carrier surface 22, contacts the same with a minimal friction. The carrier surface 22 is adjoined by the inclined terminal surface 23 which, upon normal operating speed of the carding machine, that is, as the fiber web moves rapidly, is no longer in contact with the fiber web. Arrow A shows the direction of web run with enclosed air, arrow B indicates the direction of the separated air stream and arrows C and D (FIG. 2) indicate the rotary direction of the upper and lower crushing roll 7, 8, respectively.

FIG. 3 shows another embodiment of the web guiding body 15 which in its zone oriented towards the web guiding surface 9*a* of the web guiding element 9 is provided with an air outlet opening 18 (also shown in FIG. 3*d*) which extends from the downstream end (as viewed in the direction of web travel) of the supporting surface 16*a* to the underside 16*b* of the guiding body 15. As shown in Figure 3*a*, the run-on edge 17 of the guiding body 15 is rounded. The supporting surface 16*a* is planar and is situated beneath the center line 14*a* of the guiding element aperture 14.

Figure 3A:
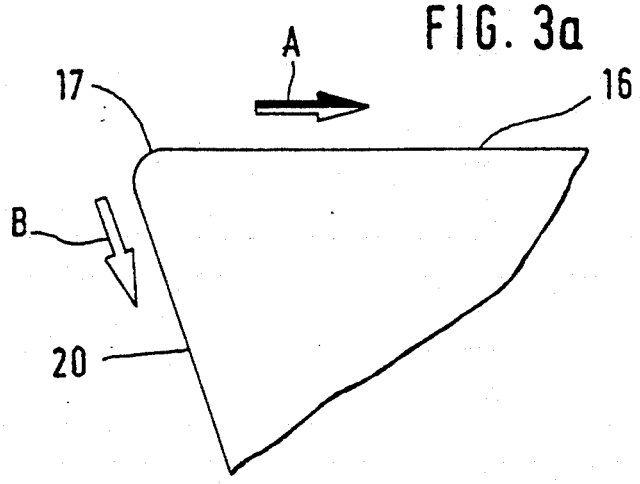
FIG. 3*a* is a fragmentary side elevational view of the guiding body shown in FIG. 3.
Figure 3B:
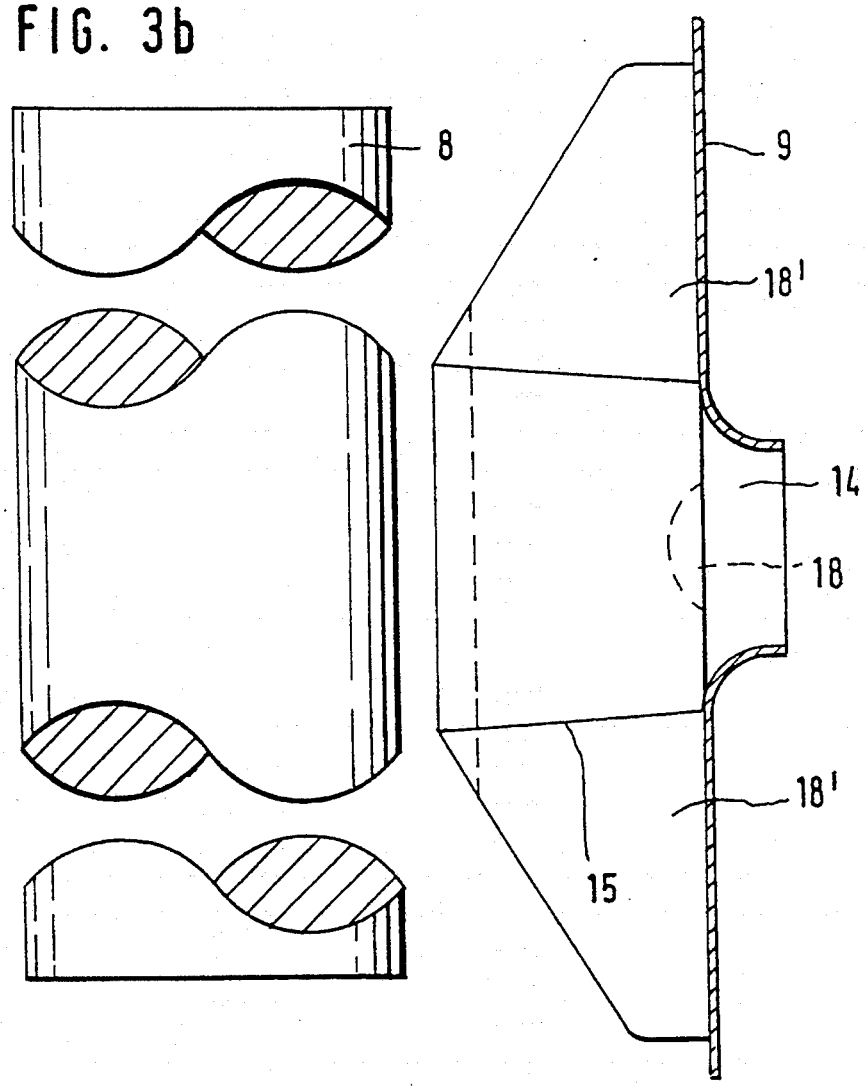
FIG. 3*b* is a sectional view taken along line IIIb—IIIb of FIG. 3.
Figure 3C:
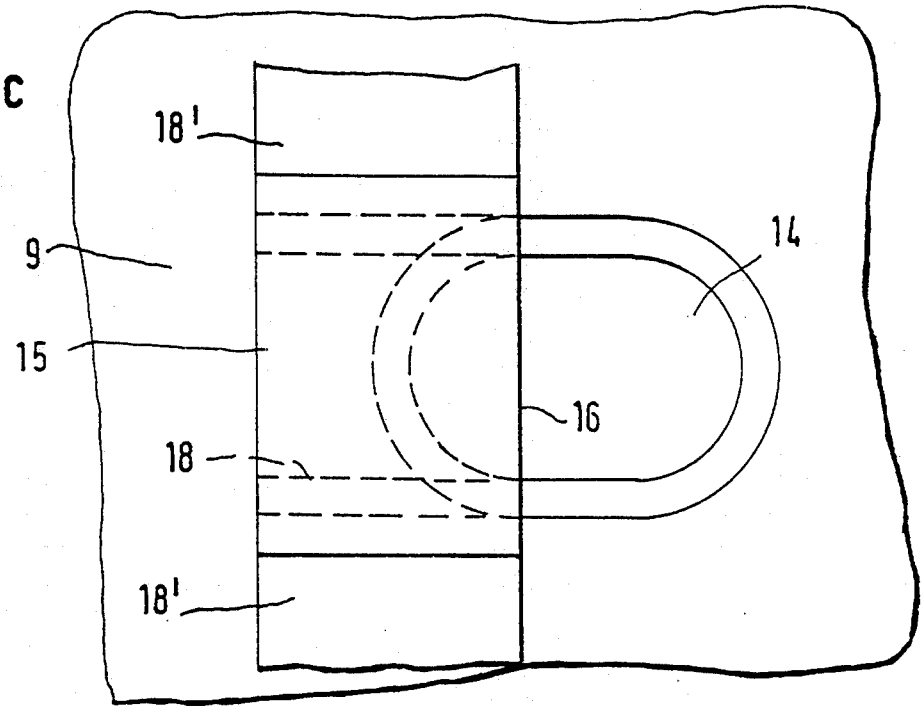
FIG. 3*c* is a fragmentary rear elevational view of components shown in FIG. 3, as viewed in the direction of arrow IIIc.
Figure 3D:
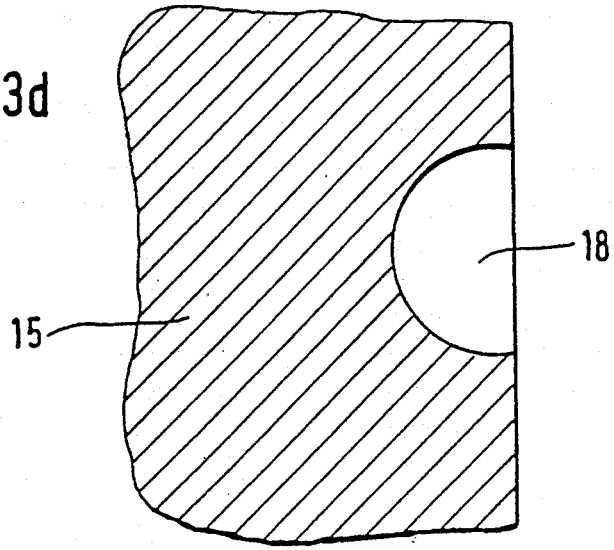
FIG. 3*d* is a sectional view taken along line IIId—IIId of FIG. 3.

FIGS. 3*b* and 3*c* additionally show that between the web guiding element 9 and the web guiding body 15, in the zone externally of the guiding element aperture 14, air outlet openings 18' are laterally arranged which are obtained by an oblique cut of the web guiding body 15 laterally of the aperture 14.

Figure 4:
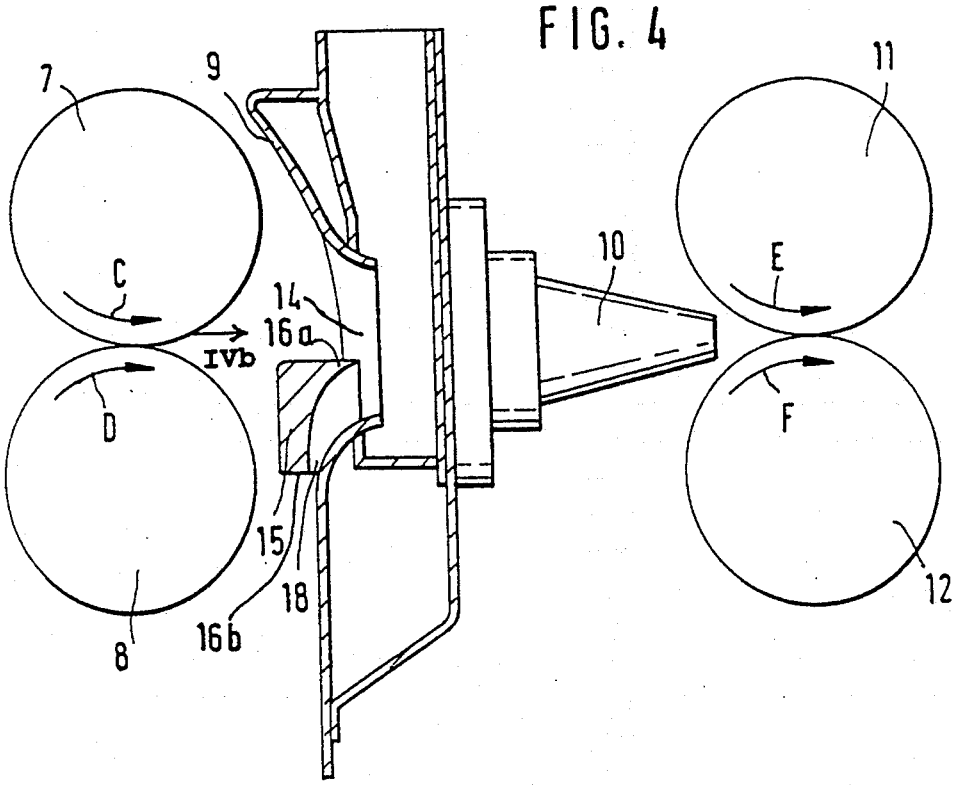
FIG. 4 is a sectional side elevational view of a web delivering mechanism, a guiding body according to a further preferred embodiment, a sliver trumpet and calender rolls of a carding machine.

FIG. 4 shows in further detail the assembly situated downstream of the stripping roll 6 in FIG. 1. There are thus illustrated the crushing rolls 7, 8 (web delivering mechanism), the guiding body 15 provided with the air outlet opening 18, the web guiding element 9, the sliver trumpet 10 and the calender rolls 11, 12, whose direction of rotation is indicated by the arrows E and F, respectively.

Figure 4A:
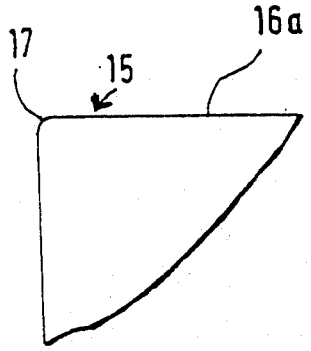
FIG. 4*a* is a fragmentary side elevational view of the guiding body of FIG. 4.
Figure 4B:
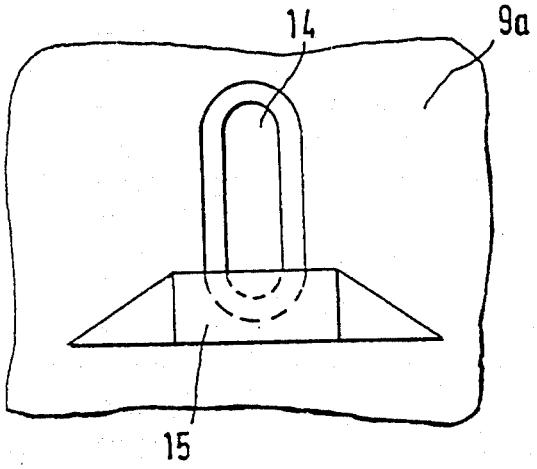
FIG. 4*b* is a fragmentary rear elevational view of some of the components shown in FIG. 4, as seen in the direction of the arrow IVb.

FIGS. 4*a* and 4*b* show that the web guiding body essentially has a rectangular cross section and the run-on edge 17 is rounded. The aperture 14 of the web guiding element is elongated vertically. In this embodiment too, the guiding body 15 is provided with an air outlet opening 18 (FIG. 4) which extends from the supporting surface 16*a* to the lower bounding surface 16*b*.

Figure 5:
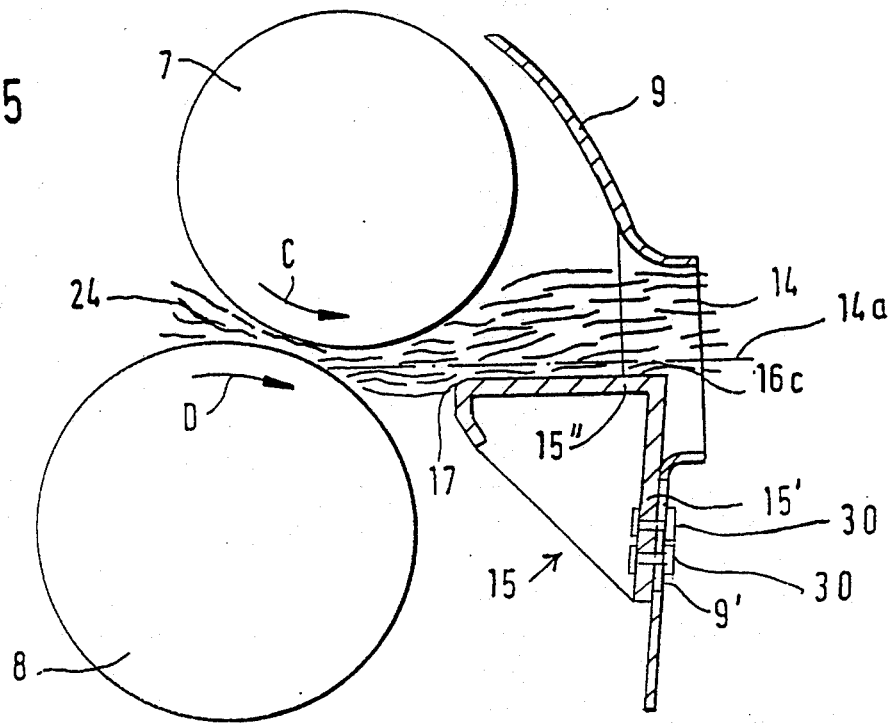
FIGS. 5–8 are sectional side elevational views of a web delivering mechanism, a web guiding element and a guiding body according to four further preferred embodiments of the invention.

FIG. 5 shows an embodiment in which the guiding body 15 is constituted by an angled sheet metal piece which has a longer leg 15' and a shorter leg 15''. The longer leg 15' is designed as a carrier leg and is secured to the web guiding element 9 by means of screws 30. The screws pass through a longitudinal slot 9' of the web guiding element 9 so that the supporting surface 16*c* may be adjusted in its height and thus may be brought into different distances from the mid line 14*a* of the aperture 14. The screw connection allows for an easy removal and/or replacement of the guiding body 15.

Figure 6:
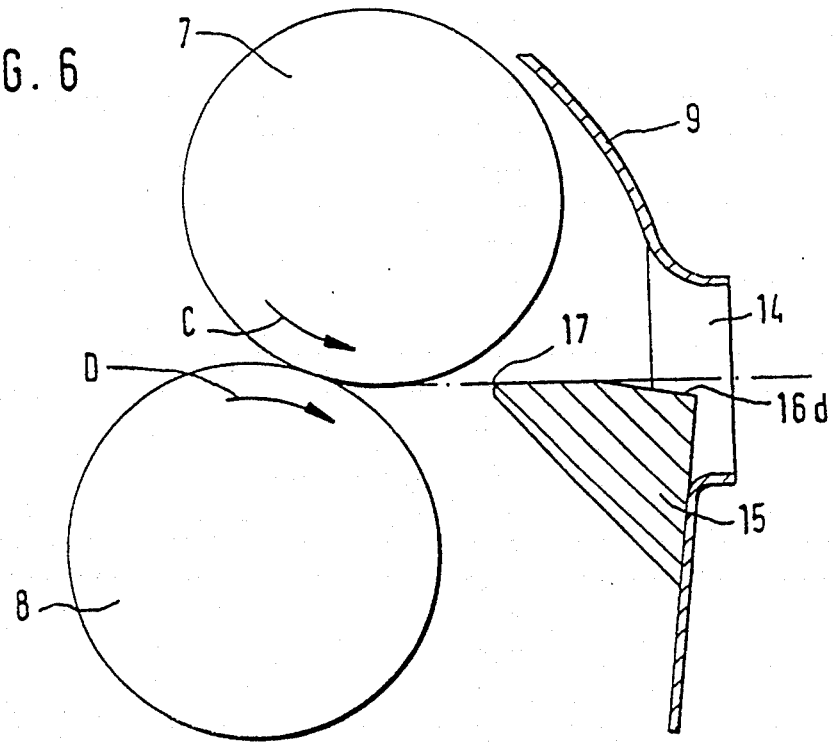

FIG. 6 shows a web guiding body 15 which essentially has a vertical triangular cross section wherein the run-on edge 17 oriented towards the rolls 7, 8 is rounded and the supporting surface 16*d* is at a downward inclination in its zone adjacent the aperture 14 of the web guiding element 9.

Figure 7:
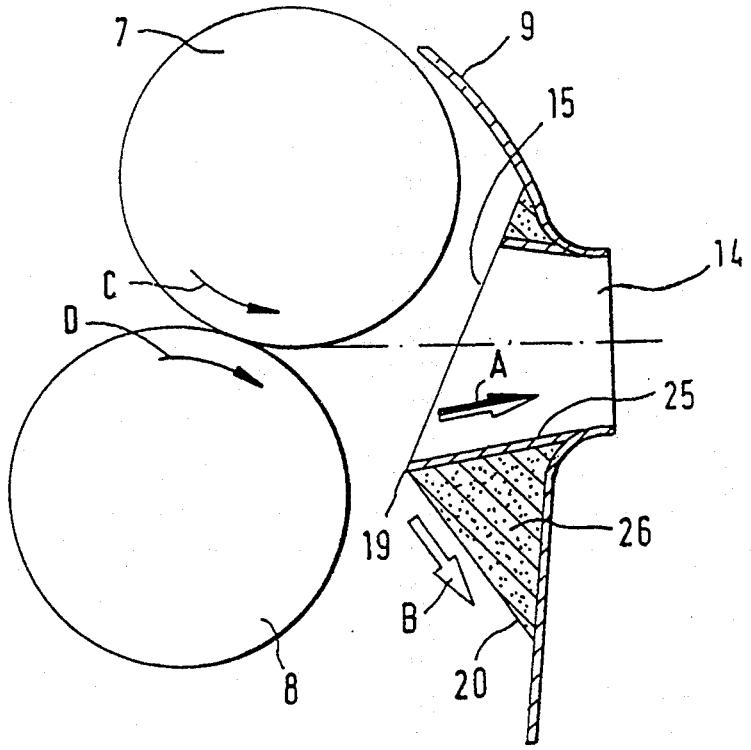
Figure 8:
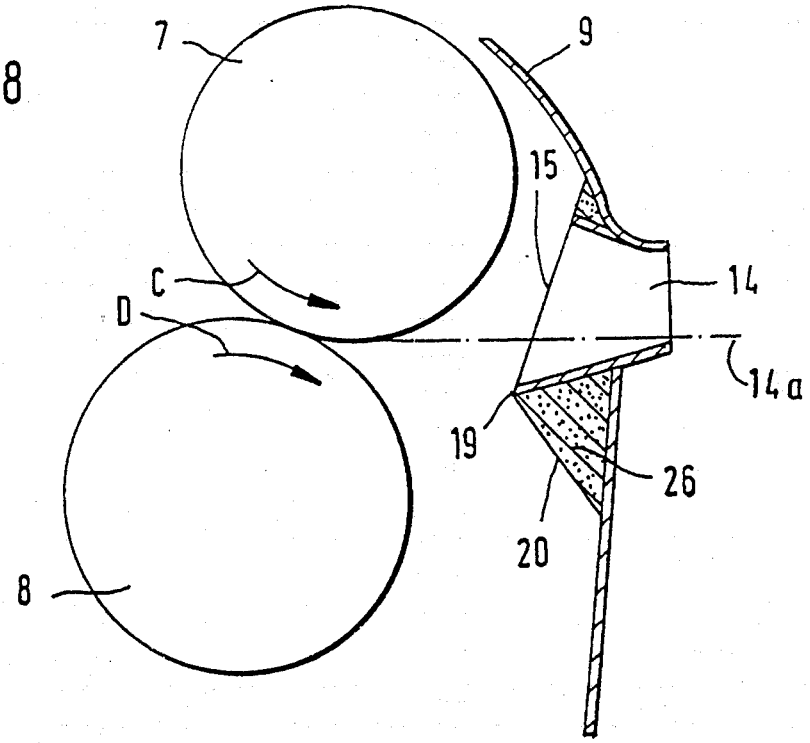
Figure 9:
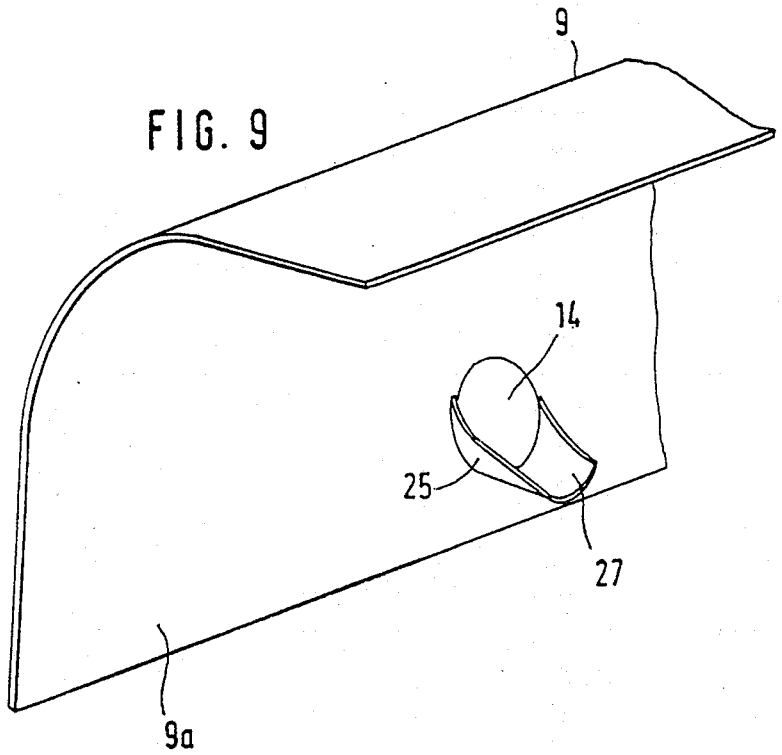
FIG. 9 is a fragmentary perspective view of a web guiding element and a guide body according to a further preferred embodiment.

FIGS. 7, 8 and 9 show a guiding body 15 formed as an angularly cut hollow frustocone segment 25 which directly projects into the outlet aperture 14 of the web guiding element 9. The zone which surrounds the funnel-like opening of the hollow cone segment 25 are surrounded by a compensating member 26 which has a frustoconical opening form-fittingly accommodating the guiding body 25. The compensating member may be obtained by placing a filler putty around the guiding body 25. The air separating surface 20 is formed by an outer face of the filler.

FIG. 7 differs from FIG. 8 in that in FIG. 8 the guiding body 25 is situated to a greater extent above the center line 14*a*, that is, the guiding body 25 is not centrally arranged as is the case in FIG. 7.

FIG. 9 is a perspective view of the web guiding element 9 and the hollow frustocone segment (guiding body) 25, whose lower zone forms a trough 27.

Figure 10A:
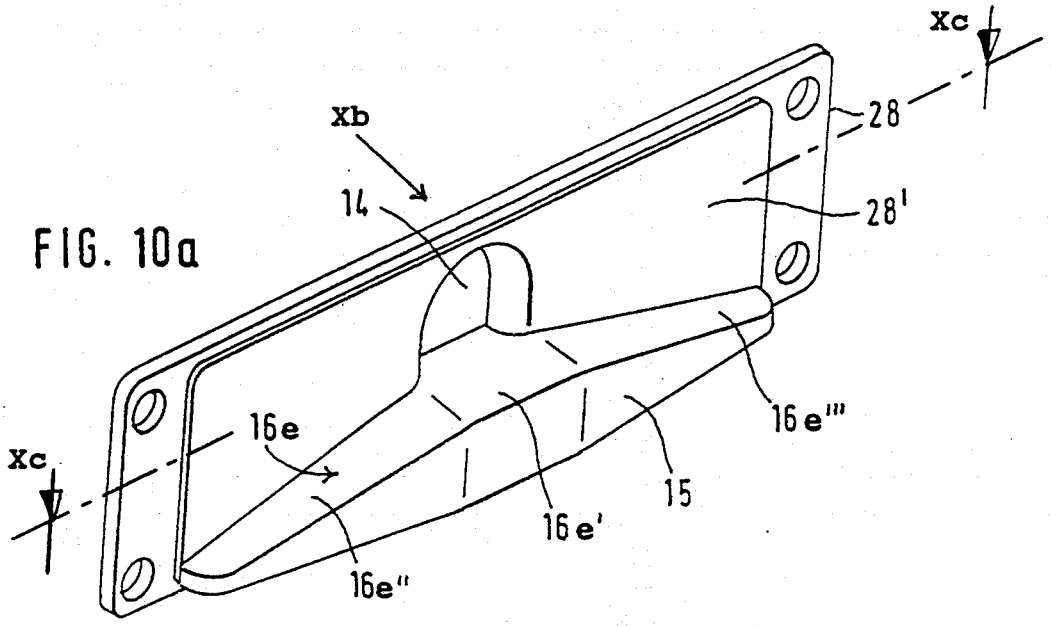
FIG. 10*a* is a perspective view of yet another preferred embodiment.
Figure 10B:
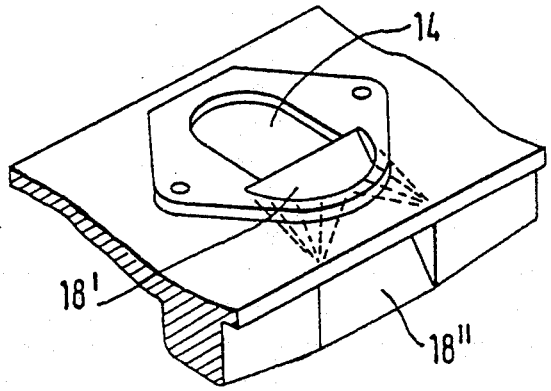
FIG. 10*b* is a fragmentary perspective view of the structure shown in FIG. 10, as seen in the direction of the arrow Xb.

According to the embodiment illustrated in FIG. 10*a*, the guiding body 15 and a rectangular holding plate 28 constitute a one-piece, cast steel unit. The surface of the unit is polished and chrome-plated and is thus smooth to such an extent that, particularly at high speeds, the web glides thereon without difficulties. The supporting surface 16*e* of the guiding body 15 has a mid zone 16*e'* which is situated in front of the web passage aperture 14 and two lateral, downwardly sloping run-on surfaces 16*e''* and 16*e'''*. The run-on surfaces 16*e''* and 16*e'''* guide the web towards the mid zone 16*e'*. FIG. 10*b* illustrates the inlet 18' and the outlet 18'' of the air passage 18.

Figure 10C:
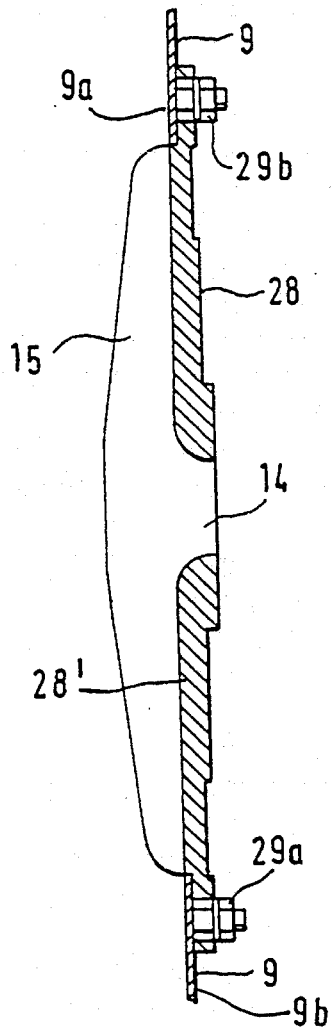
FIG. 10*c* is a sectional view taken along line Xc—Xc of FIG. 10*a*.

As illustrated in FIG. 10*c*, the web guiding element 9 has a large opening into which fits an elevated portion 28' of the holding plate 28 which, in turn, is fastened to an outer face 9*b* of the web guiding element 9 by screws 29*a*, 29*b*. The guiding body 15 projects through the large opening of the web guiding element 9 and is thus disposed at the inner face 9*a* of the web guiding element 9. As seen in FIGS. 10*a* and 10*c*, the guiding body 15 is situated on the elevated portion 28' of the holding plate 28 and, in the mounted state the elevated portion 28' is flush with the inner face 9*a* of the web guiding element 9. In this embodiment the web passage aperture 14 is provided in the holding plate 28 and thus the holding plate 28 functions as a part of the web guiding element 9.

It will be understood that the above description of the present invention is susceptible to various modifications, changes and adaptations, and the same are intended to be comprehended within the meaning and range of equivalents of the appended claims.

What is claimed is:

1. In a carding machine including a web delivering means for discharging a fiber web; the fiber web having a web plane and a direction of advance; said web delivering means being formed of a pair of cooperating rolls; and a web guiding element positioned immediately downstream of the roll pair as viewed in said direction of advance; said web guiding element having an inner surface oriented towards said roll pair and being arranged transversely to said web plane for guiding and gathering the web; said web guiding element further having a web passage aperture through which the gathered web passes and leaves the web guiding element;

the improvement comprising a guiding body positioned between said roll pair and said web guiding element in a zone of said aperture; said guiding body including a supporting surface extending in said direction of advance between said roll pair and said web guiding element at least to a location where the web enters said aperture for supporting the gathered web prior to the passage thereof through said aperture.

2. The carding machine as defined in claim 1, wherein said guiding body, as positioned, has an upper face constituting said supporting surface.

3. The carding machine as defined in claim 1, wherein said guiding body is a sheet metal member.

4. The carding machine as defined in claim 1, wherein said guiding body, as positioned, has a generally rectangular cross-sectional shape as viewed in a vertical section.

5. The carding machine as defined in claim 1, wherein said guiding body has a rounded run-on edge oriented toward said roll pair.

6. The carding machine as defined in claim 1, further comprising means for securing said guiding body to said web guiding element.

7. The carding machine as defined in claim 1, wherein said web passage aperture defines a passage area; further wherein said guiding body projects into said passage area.

8. The carding machine as defined in claim 1, wherein said web passage aperture has a horizontal width dimension; said guiding body extending substantially only along said width dimension.

9. The carding machine as defined in claim 1, wherein said guiding body has a first horizontal width extending transversely to said direction adjacent said web passage aperture and a second horizontal width extending transversely to said direction adjacent said roll pair; said first horizontal width being smaller than said second horizontal width.

10. The carding machine as defined in claim 1, wherein said web passage aperture has a center line extending parallel to said direction of web advance; said supporting surface being located at least approximately at a height level of said center line.

11. The carding machine as defined in claim 1, wherein said web passage aperture has a center line extending parallel to said direction of web advance; said center line dividing said web passage aperture into upper and lower portions; said guiding body covering at least one part of said lower portion.

12. The carding machine as defined in claim 1, wherein said web passage aperture has a center line extending parallel to said direction of web advance; said center line dividing said web passage aperture into upper and lower portions; further comprising means for defining an air outlet passage situated between said supporting surface and said lower portion of said web passage aperture.

13. The carding machine as defined in claim 1, further comprising means for defining air outlet openings between said supporting surface and lateral zones of said web passage aperture.

14. The carding machine as defined in claim 1, wherein said web passage aperture has a center line extending parallel to said direction of web advance; said center line dividing said web passage aperture into upper and lower portions; further wherein said guiding body has a throughgoing air outlet passage situated between said supporting surface and said lower portion of said web passage aperture.

15. The carding machine as defined in claim 1, wherein said web passage aperture has a lower end; said supporting surface being situated at a height level of said lower end.

16. The carding machine as defined in claim 1, wherein said guiding body spans a space between said roll pair and said web passage aperture.

17. The carding machine as defined in claim 1, wherein said rolls of said roll pair define a bight; further wherein said supporting surface of said guiding body is situated substantially at a height level of said bight.

18. The carding machine as defined in claim 1, wherein said supporting surface has a low coefficient of friction.

19. The carding machine as defined in claim 1, wherein said guiding body has an air separating edge oriented toward said roll pair.

20. The carding machine as defined in claim 19, wherein said air separating edge is rounded.

21. The carding machine as defined in claim 1, wherein said guiding body has an air separating surface oriented toward said roll pair.

22. The carding machine as defined in claim 21, wherein said supporting surface and said air separating surface are inclined toward one another at an angle other than zero.

23. The carding machine as defined in claim 22, wherein said angle is acute.

24. The carding machine as defined in claim 22, wherein said guiding body has an air separating edge oriented toward said roll pair; said supporting surface and said air separating surface forming said air separating edge.

25. The carding machine as defined in claim 1, wherein said supporting surface has a portion sloping downwardly toward said web passage aperture.

26. The carding machine as defined in claim 1, wherein said supporting surface has rounded lateral zones.

27. The carding machine as defined in claim 1, wherein said supporting surface is trough-shaped.

28. The carding machine as defined in claim 1, wherein said guiding body has the shape of a hollow frustocone segment.

29. The carding machine as defined in claim 1, wherein said supporting surface is divided into a run-on surface, a carrier surface and a terminal surface; said run-on, carrier and terminal surfaces being consecutively arranged in said direction of web advance; said run-on surface sloping upwardly and said terminal surface sloping downwardly as viewed in said direction of web advance.

30. The carding machine as defined in claim 29, wherein said web passage aperture has a center line extending parallel to said direction of web advance and further wherein said rolls of said roll pair define a bight; said carrier surface being situated between said bight and said web passage aperture and extending parallel to said center line.

31. The carding machine as defined in claim 1, wherein said guiding body, as positioned, has a generally triangular cross-sectional shape as viewed in a vertical direction.

32. The carding machine as defined in claim 1, further comprising means for releasably securing said guiding body to said web guiding element.

33. The carding machine as defined in claim 1, wherein said web guiding element and said guiding body constitute a one-piece, integral component.

34. The carding machine as defined in claim 1, further comprising a holding plate forming a one-piece, integral component with said guiding body; said holding plate being secured to said web guiding element.

35. The carding machine as defined in claim 34, wherein said web guiding element comprises a plate member having a throughgoing opening, said holding plate fitting in said opening and having a surface being flush with an inner face of said plate member; said holding plate forming part of said web guiding element; said web passage aperture being provided in said holding plate.

36. The carding machine as defined in claim 35, wherein said supporting surface and said holding plate are polished.

37. The carding machine as defined in claim 36, wherein said supporting surface and said holding plate are chrome-plated.

38. The carding machine as defined in claim 1, wherein said supporting surface has a mid zone and two lateral run-on zones flanking said mid zone; said lateral run-on zones sloping downwardly away from said mid zone.

39. The carding machine as defined in claim 1, further comprising means for adjusting a position of said guiding body for varying a height position of said supporting surface.

* * * * *